United States Patent [19]

Stich et al.

[11] 4,386,892

[45] Jun. 7, 1983

[54] HYDROSTATIC MESHING GEAR MACHINE WITH ARCUATE TOOTH FLANKS

[75] Inventors: Bodo Stich, Urspringen; Horst Fischer, Lohr; Helmut Schulz, Witten-Bommern, all of Fed. Rep. of Germany

[73] Assignee: G. L. Rexroth GmbH, Fed. Rep. of Germany

[21] Appl. No.: 197,937

[22] Filed: Oct. 17, 1980

[30] Foreign Application Priority Data

Oct. 31, 1979 [DE] Fed. Rep. of Germany ..... 2943948

[51] Int. Cl.[3] ..... F03C 2/08; F04C 2/10; F16H 55/08

[52] U.S. Cl. ..... 418/170; 74/390; 74/462

[58] Field of Search ..... 418/150, 166–171; 74/390, 413, 460, 462, 804, 805

[56] References Cited

U.S. PATENT DOCUMENTS 2,091,317 8/1937 Hill ..... 418/171

FOREIGN PATENT DOCUMENTS 292464 8/1971 Austria .
358932 10/1980 Austria .
1266134 4/1968 Fed. Rep. of Germany .
2758376 7/1979 Fed. Rep. of Germany .
16508 of 1913 United Kingdom .

*Primary Examiner*—John J. Vrablik
*Attorney, Agent, or Firm*—Roylance, Abrams, Berdo & Farley

[57] ABSTRACT

In a hydrostatic gear machine of the type having an internally toothed outer gear and an externally toothed inner gear wherein the gears have different numbers of teeth, the gears being meshed with the outer gear surrounding gear, particularly advantageous relationships between the numbers of teeth and the shapes of the tooth flanks are provided to permit economic manufacture of the machine for use as a motor or pump.

9 Claims, 3 Drawing Figures

HYDROSTATIC MESHING GEAR MACHINE WITH ARCUATE TOOTH FLANKS

This invention relates to an improved hydrostatic gear machine of the type having an internally toothed outer gear meshing with an externally toothed inner gear, particularly for use in a hydraulic pump or motor.

BACKGROUND OF THE INVENTION

In known gear machines of the general type to which the invention relates, severe disadvantages have been the expense of their production and the need to maintain precise spacing between the axles of the gears. When producing such a gear machine, one would normally begin with a tooth profile for one of the gears in the shape of a trochoid, a cycloid or a circular arc. The profile of the teeth of the meshing or counter gear is then usually determined empirically as a result of which the making of tools for producing counter gears having the necessary high quality is made very difficult if not impossible. It is particularly problemmatical to develop tools for the generating process since one can operate only with greater dimensional variations or tolerances or else with expenditures which are, economically, not justifiable.

At the present time, special gear teeth of the type requireed are produced in two stages, the first stage being a preliminary shaping with a gear cutting tool (hobbing tool) leaving relatively great tolerances from the final product. The second stage is improvement in the shape and surface quality of the teeth, accomplished by shape grinding. When the degree of overlap between the teeth of the two gears is relatively great, then the spacing between the axles of the gears must be very precisely established in order to avoid disturbances of the gear meshing and mechanically caused noises resulting from manufacturing tolerances. In order to reduce the degree of overlap, the addendum area is frequently shortened which, however, results in additional undesirable dead volume.

BRIEF DESCRIPTION OF THE INVENTION

An object of the present invention is to provide an improved gear machine in which the tooth profile is formed to provide optimum performance with regard to fluid conveying capacity, pulsation of the conveyed stream, frequency of tooth engagement, noise behavior, space requirements and dead volume, and wherein the machine can be reproduced economically and the characteristics of which can be verified, i.e., as to quality control.

Briefly described, the invention includes a hydrostatic gear machine of the type having an internal gear with inwardly extending teeth, an external gear with outwardly extending teeth, the external gear being surrounded by and meshing with the internal gear, and wherein each tooth of the generating one of said gears has tooth flanks which, as viewed axially, are at least partly arcuate, and wherein the shapes of the active tooth flanks of the other, produced, one of said gears is determined by the hobbing of the teeth of the first, generating one of said gears, the improvement wherein said first gear has an odd number of teeth between 11 and 17, inclusive, the pressure angle of said teeth at the pitch point is between about 30° and about 40°, each flank of each tooth of said one gear is defined by first, second and third successive arcs selected such that the ratio of the addendum circle radius to the radius of each of said arcs is, respectively, between 30 and 40, between about 0.55 and about 0.9 and between about 15 and about 25, said arcs merge tangentially into each other and into one of the addendum and dedendum circles of the gear with each tooth flank being predominantly convex, and the height of each tooth is substantially equal to the tooth thickness as measured on the pitch circle.

In another aspect, the invention includes, in a hydrostatic gear machine of the type having an internal gear with inwardly extending teeth, and an external gear with outwardly extending teeth, the external gear being surrounded by and meshing with the internal gear, and wherein each tooth of the first, generating one of said gears has tooth flanks which, as viewed axially, are at least partly arcuate, and wherein the shapes of the active tooth flanks of the other, produced, one of said gears is determined by the hobbing of the teeth of the first, generating one of said gears, the improvement wherein said first gear has an even number of teeth between 8 and 14, inclusive, the pressure angle of said teeth at the pitch point is between about 30° and about 40°, each flank of each tooth of said first gear is defined by first, second and third successive arcs selected such that the ratio of the addendum circle radius to the radius of each of said arcs is, respectively, between about 15 and about 25, between about 0.09 and about 0.125, and between about 30 and about 40, said arcs merge tangentially into each other and into one of the addendum and dedendum circles of the gear with each tooth flank being either predominantly concave or concave and convex in substantially equal parts, and the height of each tooth is substantially equal to the tooth thickness as measured on the pitch circle.

A structure in which the teeth, especially those of the internal gear, have a circular arc flank thus takes care of the requirements for the operation of a hydrostatic gear machine and of the requirement for its profitable production. Thus, as will be described, the tooth flank in accordance with the invention consists of at least three circular arcs which pass over or merge into, one another smoothly. By varying the tooth shape parameters, angles of action, tooth height, tooth thickness and number of teeth of the generating gear, a tooth profile can be obtained for the counter (produced) gear which, to a very good approximation, is likewise composed of at least three circular arcs, and thus may similarly be produced rather simply. A gear machine having gears developed correspondingly fulfills particularly those demands for small fluctuations in the conveying or conveyed stream, the least possible dead volume, the greatest possible conveying output, the smallest possible space requirement, and small volume of leakage by positioning a filler piece occupying a relatively large angle between the gears so that as many tooth heads as possible lie directly opposite the filler piece. At the same time, a degree of overlapping results, which is smaller than 2, and particularly smaller than 1.5, as a result of which deviations of the axles of the gears due to wear and fabrication tolerances will have a less disadvantageous effect.

In order that the manner in which the foregoing and other objects are attained in accordance with the invention can be understood in detail, particularly advantageous embodiments thereof will be described with reference to the accompanying drawings, which form a part of this specification, and wherein.

It will observed that the embodiment chosen for illustration is a geared pump, but that a gear motor can be developed in the same manner as the pump.

Figure 1:
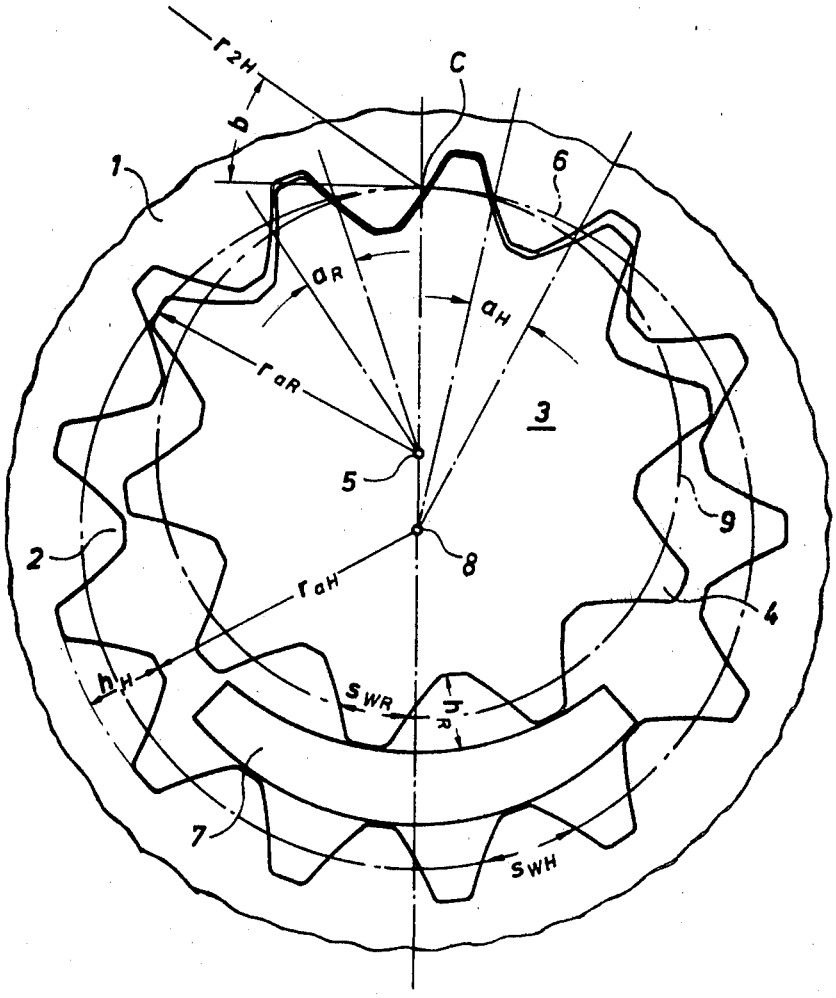
FIG. 1 is a schematic side elevation of a geared pump constructed in accordance with the invention.
Figure 2:
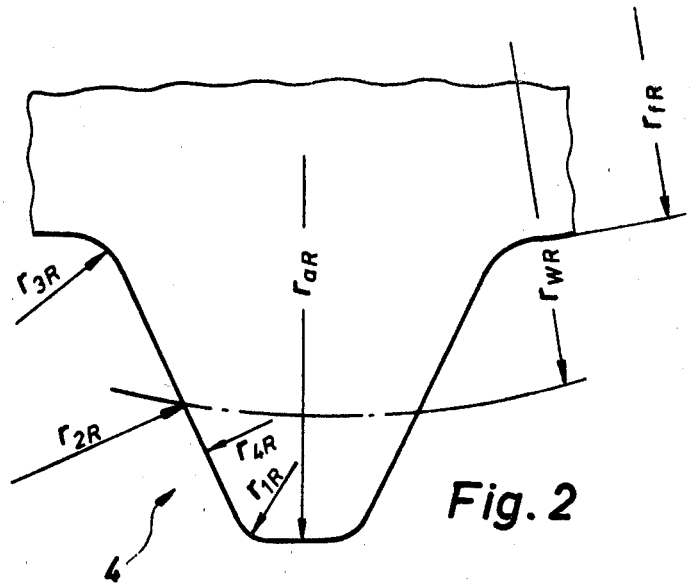
FIG. 2 is an enlarged partial side elevation of a tooth of the external gear of FIG. 1.
Figure 3:
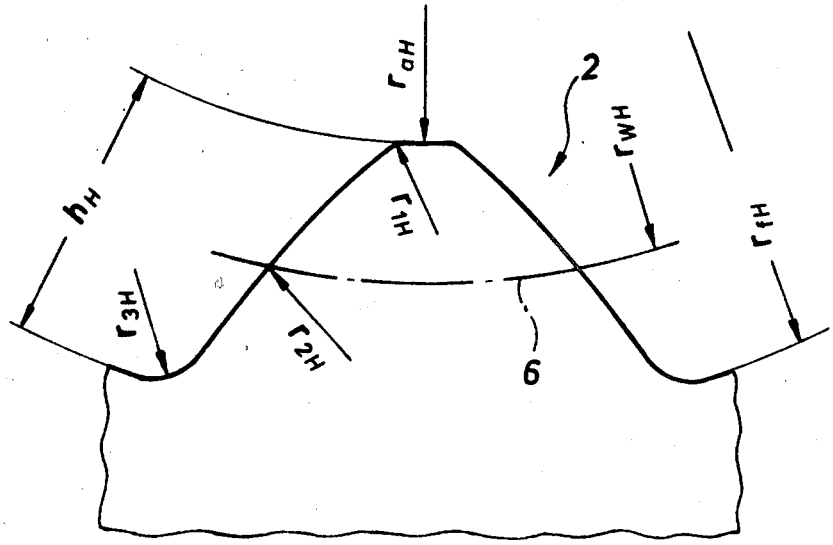
FIG. 3 is an enlarged parial side elevation of a tooth of the internal gear of FIG. 1.

As shown in the drawings, and particularly in FIG. 1, the apparatus includes an internal gear 1 having 13 teeth 2, gear 1 being rotatable about a fixed axis. An inside gear 3 has 10 teeth 4 and is rotatably mounted on an axle 5. Teeth 2 and 4 mesh with each other, examples of one each of teeth 2 and 4 being shown at an enlarged scale in FIGS. 3 and 2, respectively.

In the embodiment illustrated, the internal gear 1 is the generating gear. The width or thickness Swh (which is always measured in the conventional manner along pitch circle 6) of each tooth and, thus, also the tooth height hH, which is equal to the tooth thickness, results from the diameter of the pitch circle 6 in accordance with a predetermined number of teeth. The ratio of the addendum radius raH to the radius of the pitch circle 6 is about 0.9.

The angle of action b at the rolling point C amounts to 35° whenever the axles 5 and 8 of the two gears 3 and 1 and of the rolling point C lie on one line, and the ratio of the addendum radius raH to the flank radius r2H lying in the area of the pitch circle is 0.7. The tooth flank arcs pass over or merge tangentially into one another and into the addendum and root or dedendum circles.

The ratios of the addendum circle raH to each of the two flank radii r1H and r3H and to the tooth height hH amount, respectively, to 35, 20 and 3.75. The ratio of the flank radius r2H to each of the two remaining flank radii r1H and r3H equals 50 and 30, respectively, and the ratio of the flank radius r3H to the flank radius r1H amounts to 1.7. The flank shape of the internal gear 2 as viewed from the side is, for its major part, curved convexly.

The tooth shape of the inside gear 3, produced in accordance with the teeth 2 of internal gear 1, the inside external gear having ten teeth and a pitch circle 9, then has the following characteristics:

The radio of the addendum radius raR to each of the four flank radii r1R, r2R, r3r, and r4R is then, respectively, 20, 0.1, 35 and 0.1. The ratio of the pitch circle radius of the internal gear 1 to that of the inside gear 3 is 1.3. In the inside gear, the tooth height hR is approximately equal to the tooth thickness swR, again measured along the pitch circle of the inside gear.

The flanks of the teeth 4 of the inside gear 3, viewed from the side or axially, likewise form, to a very good approximation, three of four circular arcs, as desired, which merge tangentially into the addendum and dedendum circles. The flank of tooth 4, viewed from the side, can have a shape which is predominantely concave, whenever it is determined by three radii, or with a shape which is both convex and concave whenever it is determined by four radii, in which case the concave and convex portions are of about equal extent.

For the provision of crest and flank clearance necessary for the functioning of the pump, the flanks of the teeth 2 of the internal gear 1 or else the teeth 4 of the inside gear 3 are shifted by a few one hundredths of a millimeter radially in the direction toward the middle.

Advantageous diameters of the pitch circle lie, for the internal gear, between 35 and 200 millimeters.

In the free space between internal gear 1 and inside gear 3 a filler piece 7 is provided in a conventional manner. The middle of the internal gear is indicated at 8.

The foregoing figures are illustrative of a specific preferred embodiment of the apparatus, but it will be recognized that the various ratios can occupy certain ranges, and these ranges are as follows:

| Outer, internal gear (generating gear) | |
|---|---|
| hH = swH | |
| number of teeth 2 odd, from 11 to 17 | |
| pressure angle at pitch point 30° to 40° | |
| ratios: | range |
| raH:r1H | 30 to 40 |
| raH:r2H | 0.55 to 0.9 |
| raH:r3H | 15 to 25 |
| r2H:r1H | 40 to 60 |
| r2H:r3H | 25 to 35 |
| raH:hH | 3.5 to 4 |
| raH:rwH | about 0.9 |
| **Inner, external gear (produced gear)** | |
| number of teeth 4: even, from 3 to 5 less than teeth 2 | |
| hr = swR | |
| ratios: | range |
| raR:r1R | 15 to 25 |
| raR:r2R | 0.075 to 0.125 |
| raR:r3R | 30 to 40 |
| rwH:rwR | 1.2 to 1.4 |
| raR:r4R (if used) | 0.075 to 0.125 |

Certain additional values are indicated on the drawings, including rwH and rwR which are the radii of the pitch circles of the internal gear 1 and of the external gear 3, respectively. The radii rfH and rfR are those of the base circles of the teeth of the internal gear 1 and external gear 3, respectively. The angles aH and aR are the included angles measured to the thickness measuring points on the pitch circles of the teeth of the internal and external gears, respectively.

Whenever the inside gear is the generating gear, there are certain changes which result as compared with the previously described embodiment. First, the number of teeth of the generating inside gear preferably is 10, and the ratio of the addendum circle radius to each of the three flank radii r1R, r2R and r3R, respectively are 20, 0.1 and 35.

The ratio of the flank radius r2R to each of the two remaining flank radii r1R and r3R equal, in the case of the inside gear, 200 and 325, respectively, and the ratio of the two flank radii r3R and r1R equals 0.6. The flank form of the generating inside gear is either overwhelmingly concave or curved concave-convex with those portions occupying substantially equal parts.

In the case of the inside gear, the addendum circle radius raR to the pitch circle radius rwR equals 1.175. The counter flank on the internal gear produced with such an inside gear is, to a very good approximation, likewise a circular arc flank which consists of three circular arcs with various radii. The major portion of the flank is convex. In the case of the generated internal gear, the ratio of the addendum circle radius raH to each of the flank radii r1H, r2H and r3H is, respectively, 35, 0.7, and 20.

The following tabulation sets forth usable ranges for this arrangement.

| Inner, external gear (generating gear) | |
|---|---|
| hr = swR | |
| number of teeth 4: even, from 8 to 14 | |
| pressure angle at pitch point: 30° to 40° | |
| ratios: | ranges |
| raR:r1R | 15 to 25 |
| raR:r2R | 0.09 to 0.125 |
| raR:r3R | 30 to 40 |
| r2R:r1R | 150 to 250 |
| r2R:r3R | 275 to 375 |
| r3R:r1R | 0.4 to 0.8 |
| raR:hR | 3.5 to 4 |
| raR:rwR | 1.1 to 1.25 |
| **Outer, internal gear (produced gear)** | |
| hH = swH | |
| number of teeth 2 odd, from 3 to 5 more than teeth 4 | |
| ratios: | ranges: |
| raH:r1H | 30 to 40 |
| raH:r2H | 0.55 to 0.9 |
| raH:r3H | 15 to 25 |
| rwR:rwH | 0.7 to 0.85 |

While certain advantageous embodiments have been chosen to illustrate the invention it will be understood by those skilled in the art that various changes and modifications can be made therein without departing from the scope of the invention as defined in the appended claims.

What is claimed is:

1. In a hydrostatic gear machine of the type having a generating internal gear with inwardly extending teeth, and a produced external gear with outwardly extending teeth, the external gear being surrounded by and meshing with the internal gear, wherein each tooth of the internal gear has tooth flanks which, as viewed axially, are at least partly arcuate, and wherein the shapes of active tooth flanks of the external gear are determined by hobbing of the teeth of the internal gear, the improvement wherein said internal gear has an odd number of teeth between 11 and 17, inclusive;

the pressure angle of said teeth at the pitch point is between about 30° and about 40°;

each flank of each tooth of said internal gear is defined by first, second and third successive arcs selected such that the ratio of the addendum circle radius to the radius of each of said arcs is, respectively, between about 30 and 40, between about 0.55 and about 0.9 and between about 15 and about 25;

said arcs merge tangentially into each other and into one of the addendum and dedendum circles of the internal gear with each tooth flank thereof being predominantly convex; and the height of each internal gear tooth is substantially equal to the tooth thickness thereof as measured on the pitch circle.

2. A machine according to claim 1 wherein in said internal gear, the ratios of the second flank radius to the first and third flank radii are, respectively, between 40 and about 60, and between about 25 and about 35;

the ratio of the third flank radius to the first flank radius is between about 1.5 and about 2;

the ratio of the addendum circle to the tooth height is between about 3.5 and about 4;

and the ratio of the addendum circle radius to the pitch circle radius is about 0.9.

3. A machine according to claim 1 or 2 wherein the difference in number of teeth between said external gear and said internal gear is between 3 and 5;

the tooth flanks of the external gear are defined by arcs and the ratios of the addendum circle radius to the radii of said flank arcs of said external gear are, respectively, between about 15 and about 25, between about 0.075 and about 0.125, and between about 30 and about 40;

the ratio of the pitch circle radii of said internal gear to said external gear is between about 1.2 and 1.4;

the tooth height of said external gear is substantially equal to the tooth thickness as measured on the pitch circle; and said flank arcs of said external gear merge tangentially into each other and into one of the dedendum and addendum circles of the gear.

4. A machine according to claim 3 wherein, in said external gear, each said tooth flank is further defined by a fourth flank arc, and wherein the ratio of the addendum circle radius to the radius of said fourth flank arc is between 0.075 and 0.125.

5. In a hydrostatic gear machine of the type having a produced internal gear with inwardly extending teeth, and a generating external gear with outwarding extending teeth, the external gear being surrounded by and meshing with the internal gear, wherein each tooth of the external gear has tooth flanks which, as viewed axially, are at least partly arcuate, and wherein the shapes of active tooth flanks of the internal gear are determined by hobbing of the teeth of the external gear, the improvement wherein said external gear has an even number of teeth between 8 and 14, inclusive;

the pressure angle of said teeth at the pitch point is between about 30° and 40°;

each flank of each tooth of said external gear is defined by first, second and third successive arcs selected such that the ratio of the addendum circle radius to the radius of each of said arcs is, respectively, between about 15 and 25, between about 0.09 and about 0.125, and between about 30 and about 40;

said arcs merge tangentially into each other and into one of the addendum and dedendum circles of the internal gear with each tooth flank thereof being either predominantly concave or concave and convex in substantially equal parts; and the height of each external gear tooth is substantially equal to the tooth thickness thereof as measured on the pitch circle.

6. A machine according to claim 5 wherein, in the external gear, the ratios of the second flank radius to the first and third flank radii are, respectively, between about 150 and about 250, and between about 275 and about 375;

the ratio of the third flank radius to the first flank radius is between about 0.4 and about 0.8;

the ratio of the addendum circle to the tooth height is between about 3.5 and about 4;

and the ratio of the addendum circle radius to the pitch circle radius is between about 1.1 and about 1.25.

7. A machine according to claim 5 or 6 wherein the difference in number of teeth between said external gear and said internal gear is between 3 and 5;

the tooth flanks of the internal gear are defined by arcs and the ratios or the addendum circle radius to the radii of said flank arcs of said internal gear are, respectively, between about 30 and about 40, between about 0.55 and about 0.9, and between about 15 and about 25;

the ratio of the pitch circle radii of the external gear to the internal gear is between about 0.7 and about 0.85;

the tooth height of said internal gear is substantially equal to the tooth thickness as measured on the pitch circle; and said flank arcs of the internal gear merge tangentially into each other and into one of the dedendum and addendum circles of the gear.

8. A gear machine according to claim 5 wherein each of the tooth flanks of one of said gears is shifted slightly from their free-play positions.

9. A gear machine according to claim 8 wherein each tooth flank of the external gear is in the form of a circular arc.

* * * * *